US006369784B1

(12) United States Patent
Maslennikov et al.

(10) Patent No.: US 6,369,784 B1
(45) Date of Patent: Apr. 9, 2002

(54) SYSTEM AND METHOD FOR IMPROVING EMITTER LIFE IN FLAT PANEL FIELD EMISSION DISPLAYS

(75) Inventors: Igor L. Maslennikov, Sunnyvale; Dennis M. Urbon, San Jose; Christopher J. Spindt, Menlo Park; Ronald L. Hansen, San Jose; Christopher J. Curtin, Los Altos Hills, all of CA (US)

(73) Assignee: Candescent Intellectual Property Services, Inc., San Jose, CA (US)

( * ) Notice: Subject to any disclaimer, the term of this patent is extended or adjusted under 35 U.S.C. 154(b) by 0 days.

(21) Appl. No.: 09/405,281

(22) Filed: Sep. 23, 1999

Related U.S. Application Data

(63) Continuation of application No. 09/144,213, filed on Aug. 31, 1998.

(51) Int. Cl.[7] ..... G09G 3/00

(52) U.S. Cl. ..... 345/75.2; 345/74.1; 345/204; 345/208; 313/339; 713/321

(58) Field of Search ..... 345/74.1, 75.2, 345/867, 208, 209, 204; 315/169.3, 169.1, 334; 313/306, 309, 310, 339, 336, 305; 713/300, 320, 321

(56) References Cited

U.S. PATENT DOCUMENTS 5,347,201 A 9/1994 Liang et al. ..... 315/366
5,642,017 A 6/1997 Hush ..... 315/169.3
5,659,328 A 8/1997 Todokoro et al. ..... 345/74
5,708,451 A 1/1998 Baldi ..... 345/75
5,742,266 A 4/1998 Onozuka ..... 345/74
5,744,914 A 4/1998 Konishi ..... 315/169.1
5,754,149 A 5/1998 Browning et al. ..... 345/75
5,764,204 A 6/1998 Bancal ..... 345/75

*Primary Examiner*—Lun-Yi Lao
(74) *Attorney, Agent, or Firm*—Wagner, Murabito & Hao LLP

(57) ABSTRACT

A field emission display having an improved operational life. In one embodiment of the present invention, the field emission display comprises a plurality of row lines, a plurality of column lines, and a plurality of electron emissive elements disposed at intersections of the plurality of row lines and column lines, a column driver circuit, and a row driver circuit. The column driver circuit is coupled to drive column voltage signals over the plurality of column lines; and, the row driver circuit is coupled to activate and deactivate the plurality of row lines with row voltage signals. Significantly, according to the present invention, operational life of the field emission display is substantially extended when the electron emissive elements are intermittently reverse-biased by the column voltage signals and the row voltage signals. In another embodiment, the row driver circuit is responsive to a SLEEP signal. The row driver circuit, upon receiving the SLEEP signal, drives a sleep-mode voltage over the row lines to reverse-bias the electron emissive elements.

21 Claims, 12 Drawing Sheets

SYSTEM AND METHOD FOR IMPROVING EMITTER LIFE IN FLAT PANEL FIELD EMISSION DISPLAYS

This application is a continuation of Ser. No. 09/144,213 Aug. 31, 1998.

FIELD OF THE INVENTION

The present invention pertains to the field of flat panel display screens. More specifically, the present invention relates to the field of flat panel field emission display screens.

BACKGROUND OF THE INVENTION

Flat panel field emission displays (FEDs), like standard cathode ray tube (CRT) displays, generate light by impinging high energy electrons on a picture element (pixel) of a phosphor screen. The excited phosphor then converts the electron energy into visible light. However, unlike conventional CRT displays which use a single or in some cases three electron beams to scan across the phosphor screen in a raster pattern, FEDs use stationary electron beams for each color element of each pixel. This allows the distance from the electron source to the screen to be very small compared to the distance required for the scanning electron beams of the conventional CRTs. In addition, the vacuum tube of the FED can be made of glass much thinner than that of conventional CRTs. Moreover, FEDs consume far less power than CRTs. These factors make FEDs ideal for portable electronic products such as laptop computers, pocket-TVs and portable electronic games.

As mentioned, FEDs and conventional CRT displays differ in the way the image is scanned. Conventional CRT displays generate images by scanning an electron beam across the phosphor screen in a raster pattern. As the electron beam scans along the row (horizontal) direction, its intensity is adjusted according to the desired brightness of each pixel of the row. After a row of pixel is scanned, the electron beam steps down and scans the next row with its intensity modulated according to the desired brightness of that row. In marked contrast, FEDs generate images according to a "matrix" addressing scheme. Each electron beam of the FED is formed at the intersection of individual rows and columns of the display. Rows are updated sequentially. A single row electrode is activated alone with all the columns active, and the voltage applied to each column determines the strength of the electron beam formed at the intersection of that row and column. Then, the next row is subsequently activated and new brightness information is set again on each of the columns. When all the rows have been updated, a new frame is displayed.

Beside the difference in image scanning methodology, a more significant difference between FEDs and conventional CRT displays is that conventional CRT displays emit electrons with "hot" cathodes, while FEDs utilize "cold" cathodes. For instance, in a conventional CRT display, a metal composite is heated to about 1200° C. to emit electrons. These electrons are then focused into a tight beam and accelerated towards the phosphor screen. In contrast, FEDs generate a high electric field by applying a voltage across a very narrow gap between emitter-tips and emitter-gates to emit electrons. Because it is not necessary to expend thermal energy to emit electrons, "cold" cathodes consume far less power than "hot" cathodes.

One drawback of the "cold" cathodes, however, is that emission efficiency of the electron emitters is moderately unstable. The electron emitters may degrade after several hours of-continuous operation, resulting in a lower emission current and a dimmer display. Some electron emitters may degrade faster than others, resulting in a display having uneven luminance across the screen. Naturally, these visual artifacts are highly undesirable for a high-quality flat panel display.

Therefore, what is needed is a system for and method of extending the operational life of FEDs. What is further needed is a system for and method of extending the operational life of FEDs that can be implemented without redesigning the entire FED screen and remain cost-effective.

SUMMARY OF THE DISCLOSURE

The present invention provides for a field emission display having an improved operational life. In one embodiment of the present invention, the FED comprises a plurality of row lines, a plurality of column lines, and a plurality of electron emissive elements disposed at intersections of the plurality of row lines and column lines, a column driver circuit, and a row driver circuit. The column driver circuit is coupled to drive column voltage signals over the plurality of column lines; and, the row driver circuit is coupled to activate and deactivate the plurality of row lines with row voltage signals. Significantly, according to the present invention, operational life of the FED is substantially extended when the electron emissive elements are intermittently reverse-biased by the column voltage signals and the row voltage signals.

In one embodiment of the invention, electron emissive elements are coupled to the row lines and gate electrodes are coupled to the column lines. According to this embodiment, the row driver circuit is configured for providing a row-off voltage that is pre-set at a relatively more positive voltage than a column-off voltage to deactivate the row line. In this way, when a row line is deactivated and when the column lines are driven below the row-off voltage, electron emissive elements disposed between the row line and the column lines are reverse-biased. Alternatively, the "off" voltage may be set above a column full-on voltage such that electron emissive elements are reverse-biased whenever the row line is deactivated.

In another embodiment of the present invention, electron emissive elements are coupled to the column lines, and the gate electrodes are coupled to the row lines. In that embodiment, the row driver circuit is configured for providing a positive row-on voltage to activate a row line, and a row-off voltage that is relatively less positive than a column-off voltage provided by the column driver circuit to deactivate the row line. Reverse-biasing of the electron emissive elements is achieved when the row line is deactivated and when the column lines are driven above the row-off voltage. Alternatively, the row-off voltage may be set below a column full-on voltage to reverse-bias the electron emissive elements when the row line is deactivated.

In yet another embodiment of the present invention, the row driver circuit and the column driver circuit are responsive to a SLEEP signal. The column driver circuit, upon receiving the SLEEP signal, drives a first sleep-mode voltage over the column lines. The row driver circuit, upon receiving the SLEEP signal, drives a second sleep-mode voltage over the row lines. According to the present embodiment, the first and second sleep-mode voltages, when asserted, cause the electron emissive elements to be reverse-biased. According to one embodiment of the invention, in FEDs where the row lines are coupled to the electron emissive elements, the second sleep-mode voltage is more positive than the first sleep-mode voltage. In another embodiment, in FEDs where the column lines are coupled to the electron emissive elements, the second sleep-mode voltage is less positive than the first-sleep mode voltage.

In furtherance of one embodiment of the present invention, electronic circuitry of the FED further comprises a controller circuit for receiving the SLEEP signal. In this embodiment, the controller circuit is configured for providing a first set of reference voltages to the row driver when the SLEEP signal is not asserted, and for providing a second set of reference voltages to the row driver when the SLEEP signal is asserted. The row driver then drives the row lines with appropriate normal-mode and sleep-mode voltages in response to the different sets of reference voltages.

In accordance with another embodiment of the present invention, the FED may include circuit means for measuring an emission current, and circuit means for adjusting the voltage difference between the row-off voltage and the column-off voltage according to a difference between the emission current and a reference current. In this way, emission efficiency of the electron emissive elements may be maintained at a constant level via a feedback mechanism.

Embodiments of the present invention include the above and wherein the electron emissive elements further comprises conical electron emissive elements each having a molybdenum tip. In addition, the FED of the present invention may include opto-isolation circuits for converting external signals corresponding to the first set of reference voltages to signals corresponding to the second set of reference voltages to be provided to the row driver circuit.

BRIEF DESCRIPTION OF THE DRAWINGS

The accompanying drawings, which are incorporated in and form a part of this specification, illustrate embodiments of the present invention and, together with the description, serve to explain the principles of the invention.

DETAILED DESCRIPTION OF THE PREFERRED EMBODIMENTS

Reference will now be made in detail to the present embodiments of the invention, examples of which are illustrated in the accompanying drawings. While the invention will be described in conjunction with the present embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description, for purposes of explanation, numerous specific details are set forth in order to provide a thorough understanding of the present invention. It will be apparent, however, to one skilled in the art, upon reading this disclosure, that the present invention may be practiced without these specific details. In other instances, well-known structures and devices are not described in detail in order to avoid obscuring aspects of the present invention.

Figure 1:
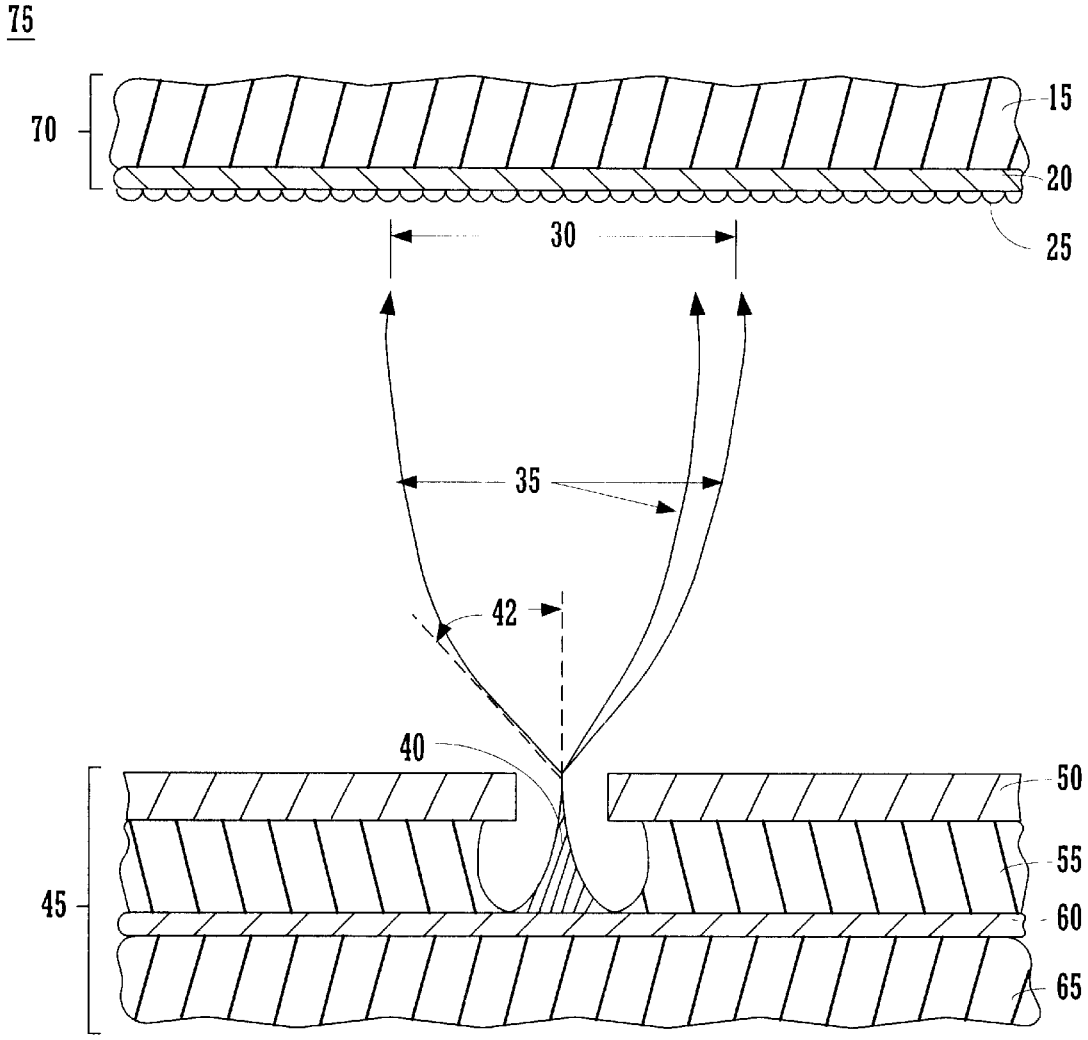
FIG. 1 is a cross section structural view of part of a flat panel FED screen that utilizes a gated field emitter situated at the intersection of a row and a column line.

A discussion of an emitter of a field emission display is presented. FIG. 1 illustrates a multi-layer structure 75 which is a portion of an FED flat panel display. The multi-layer structure 75 contains a field-emission backplate structure 45, also called a baseplate structure, and an electron-receiving faceplate structure 70. An image is generated by faceplate structure 70. Backplate structure 45 commonly consists of an electrically insulating backplate 65, an emitter (or cathode) electrode 60, an electrically insulating layer 55, a patterned gate electrode 50, and a conical electron-emissive element 40 situated in an aperture through insulating layer 55. One type of electron-emissive element 40 is described in U.S. Pat. No. 5,608,283, issued on Mar. 4, 1997 to Twichell et al. and another type is described in U.S. Pat. No. 5,607,335, issued on Mar. 4, 1997 to Spindt et al., which are both incorporated herein by reference. The tip of the electron-emissive element 40 is exposed through a corresponding opening in gate electrode 50. Emitter electrode 60 and electron-emissive element 40 together constitute a cathode of the illustrated portion 75 of the FED flat panel display. Faceplate structure 70 is formed with an electrically insulating faceplate 15, an anode 20, and a coating of phosphors 25. Electrons emitted from element 40 are received by phosphors portion 30.

Anode 20 of FIG. 1 is maintained at a positive voltage relative to cathode 60/40. The anode voltage is 100–300 volts for spacing of 100–200 um between structures 45 and 70 but in other embodiments with greater spacing the anode voltage is in the kilovolt range. Because anode 20 is in contact with phosphors 25, the anode voltage is also impressed on phosphors 25. When a suitable gate voltage is applied to gate electrode 50, electrons are emitted from electron-emissive element 40 at various values of off-normal emission angle theta 42. The emitted electrons follow non-linear (e.g., parabolic) trajectories indicated by lines 35 in FIG. 1 and impact on a target portion 30 of the phosphors 25. The phosphors struck by the emitted electrons produce light of a selected color and represent a phosphor spot. A single phosphor spot can be illuminated by thousands of emitters.

Phosphors 25 are part of a picture element ("pixel") that contains other phosphors (not shown) which emit light of different color than that produced by phosphors 25. Typically a pixel contains three phosphor spots, a red spot, a green spot and a blue spot. Also, the pixel containing phosphors 25 adjoins one or more other pixels (not shown) in the FED flat panel display. The pixels of an FED flat panel screen are arranged in a matrix form including columns and rows. In one implementation, a pixel is composed of three phosphor spots aligned in the same row, but having three separate columns. Therefore, a single pixel is uniquely identified by one row and three separate columns (a red column, a green column and a blue column).

The size of target phosphor portion 30 of FIG. 1 depends on the applied voltages and geometric and dimensional characteristics of the FED flat panel display 75. Increasing the anode/phosphor voltage to 1,500 to 10,000 volts in the FED flat panel display 75 of FIG. 1 requires that the spacing between the backplate structure 45 and the faceplate structure 70 be much greater than 100–200 um. Increasing the interstructure spacing to the value needed for a phosphor potential of 1,500 to 10,000 causes a larger phosphor portion 30, unless electron focusing elements (e.g., gated field emission structures) are added to the FED flat panel display of FIG. 1. Such focusing elements can be included within FED flat panel display structure 75 and are described in U.S. Pat. No. 5,528,103 issued on Jun. 18, 1996 to Spindt, et al., which is incorporated herein by reference.

Importantly, the brightness of the target phosphor portion 30 depends on the voltage potential applied across the cathode 60/40 and the gate 50. The larger the voltage potential, the brighter the target phosphor portion 30. Secondly, the brightness of the target phosphor portion 30 depends on the amount of time a voltage is applied across the cathode 40/60 and the gate 50 (e.g., on-time window). The larger the on-time window, the brighter the target phosphor portion 30. Therefore, within the present invention, the brightness of FED flat panel structure 75 is dependent on the voltage and the amount of time (e.g., "on-time") the voltage is applied across cathode 60/40 and the gate 50.

Figure 2:
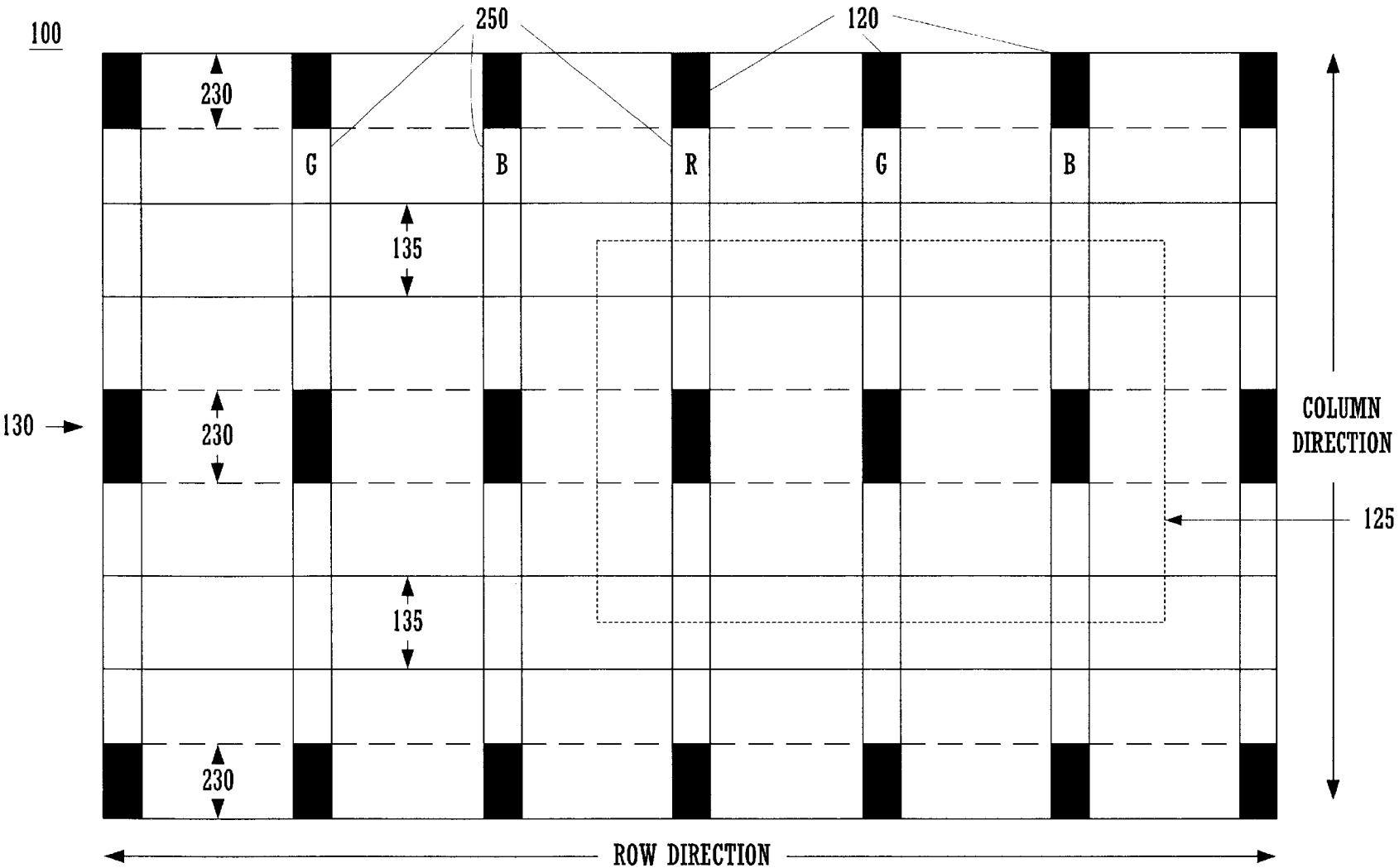
FIG. 2 is a plan view of internal portions of the flat panel FED screen of the present invention and illustrates several intersecting rows and columns of the display.

As shown in FIG. 2, the FED flat panel display is subdivided into an array of horizontally aligned rows and vertically aligned columns of pixels. A portion 100 of this array is shown in FIG. 2. The boundaries of a respective pixel 125 are indicated by dashed lines. Three separate emitter lines 230 are shown. Each row line 230 is a row electrode for one of the rows of pixels in the array. In one embodiment, the each row line 230 is coupled to the emitter cathodes 60/40 (FIG. 1) of each emitter of the particular row associated with the electrode. A portion of one pixel row is indicated in FIG. 2 and is situated between a pair of adjacent spacer walls 135. A pixel row is comprised of all of the pixels along one row line 230. Two or more pixels rows (and as much as 24–100 pixel rows), are generally located between each pair of adjacent spacer walls 135. Each column of pixels has three column lines 250: (1) one for red; (2) a second for green; and (3) a third for blue. Likewise, each pixel column includes one of each phosphor stripes (red, green, blue), three stripes total. In the present embodiment, each of the column lines 250 is coupled to the gate 50 (FIG. 1) of each emitter structure of the associated column. This structure 100 is described in more detail in U.S. Pat. No. 5,477,105 issued on Dec. 19, 1995 to Curtin, et al., which is incorporated herein by reference. It should be appreciated that, in other FED designs, the column lines may be coupled to the emitter cathodes and the row lines may be coupled to the gate electrodes, and that the present invention is applicable to those FED designs as well.

The red, green and blue phosphor stripes 25 (FIG. 1) are maintained at a positive voltage of 1,500 to 10,000 volts relative to the voltage of the emitter-cathode 60/40. When one of the sets of electron-emission elements 40 is suitably excited by adjusting the voltage of the corresponding row lines 230 and column lines 250, elements 40 in that set emit electrons which are accelerated toward a target portion 30 of the phosphors in the corresponding color. The excited phosphors then emit light. During a screen frame refresh cycle (performed at a rate of approximately 60 Hz in one embodiment), only one row is active at a time and the column lines are energized to illuminate the one row of pixels for the on-time period. This is performed sequentially in time, row by row, until all pixel rows have been illuminated to display the frame. Frames are presented at 60 Hz. Assuming n rows of the display array, each row is energized at a rate of 16.7/n ms. The above FED configuration is described in more detail in the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are incorporated herein by reference.

Figure 3:
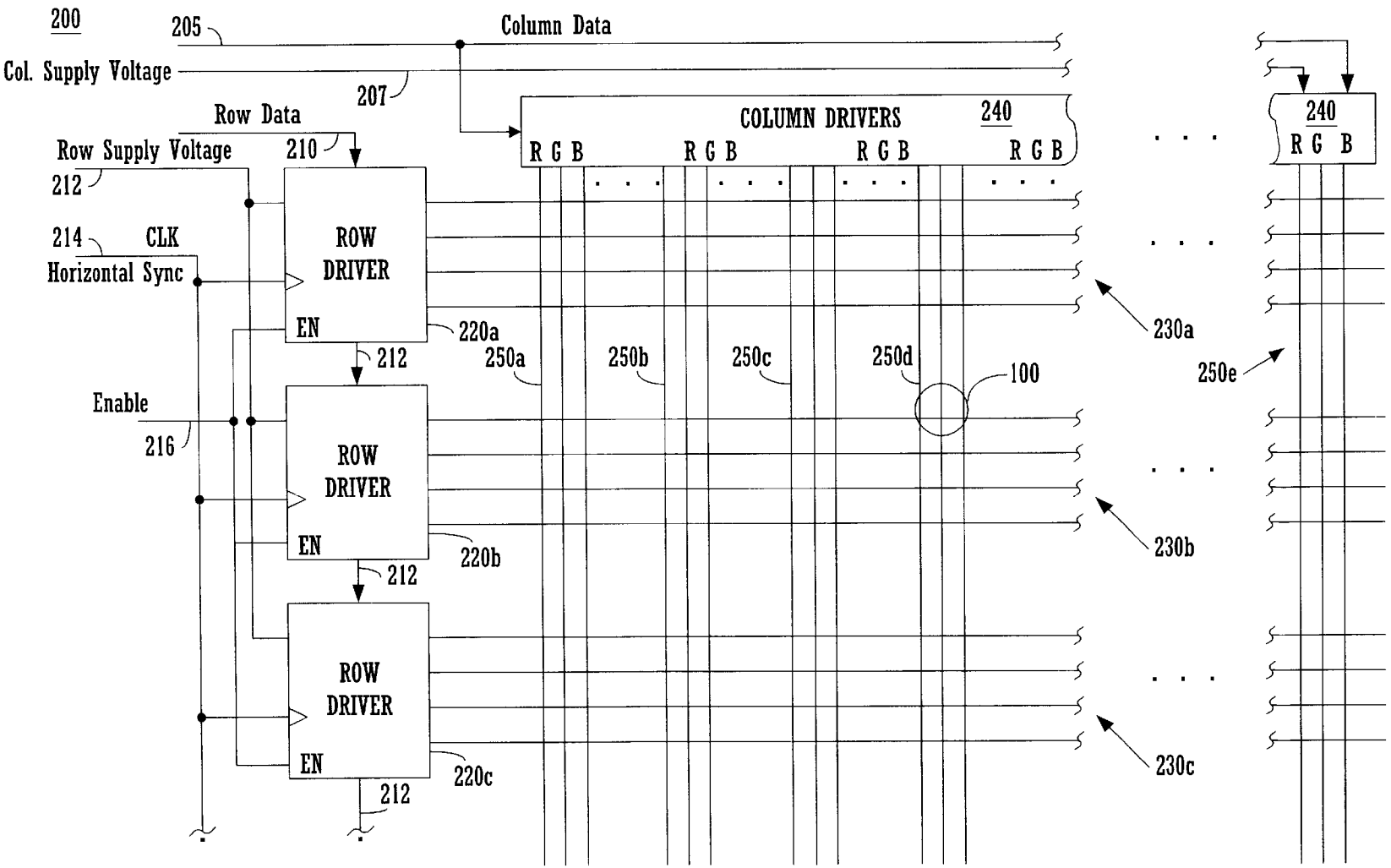
FIG. 3 illustrates a plan view of an flat panel FED screen in accordance with the present invention illustrating row and column drivers and numerous intersecting rows and columns.

FIG. 3 illustrates an FED flat panel display 200 in accordance with the present invention. Region 100, as described with respect to FIG. 2, is also shown in FIG. 3. The FED flat panel display 200 consists of n row lines (horizontal) and x column lines (vertical). For clarity, a row line is called a "row" and a column line is called a "column." Row lines are driven by row driver circuits 220*a*–220*c*. Shown in FIG. 3. are row groups 230*a*, 230*b* and 230*c*. Each row group is associated with a particular row driver circuit; three row driver circuits are shown 220*a*–220*c*. In one embodiment of the present invention there are over 400 rows and approximately 5–10 row driver circuits. However, it is appreciated that the present invention is equally well suited to an FED flat panel display screen having any number of rows. Also shown in FIG. 3 are column groups 250*a*, 250*b*, 250*c* and 250*d*. In one embodiment of the present invention there are over 1920 columns. However, it is appreciated that the present invention is equally well suited to an FED flat panel display screen having any number of columns. A pixel requires three columns (red, green, blue), therefore, 1920 columns provides at least 640 pixel resolution horizontally.

Row driver circuits 220*a*–220*c* are placed along the periphery of the FED flat panel display screen 200. In FIG. 3, only three row drivers are shown for clarity. Each row driver 220*a*–220*c* is responsible for driving a group of rows. For instance, row driver 220*a* drives rows 230*a*, row driver 220*b* drives rows 230*b* and row driver 220*c* drives rows 230*c*. Although an individual row driver is responsible for driving a group of rows, only one row is active at a time across the entire FED flat panel display screen 200. Therefore, an individual row driver drives at most one row line at a time, and when the active row line is not in its group during a refresh cycle it is inactive. Further, when a row is inactive, the corresponding row driver provides a "resting," or "row-off" voltage over the row. A supply voltage line 212 is coupled in parallel to all row drivers 220*a*–220*c* and supplies the row drivers 220*a–c* with row driving voltages.

In furtherance of the embodiments illustrated in FIGS. 1 and 2, row lines 230 are coupled to emitter electrodes 60, and column lines 250 are coupled to gate electrodes 50. Thus, in this embodiment, the row driving voltage is negative in polarity. In other embodiments, row lines may be coupled to gate electrodes and column lines may be coupled to emitter electrodes. In those embodiments, the row driving voltage would be positive in polarity.

In the embodiment illustrated in FIG. 3, an enable signal is also supplied to each row driver 220*a*–220*c* in parallel over enable line 216. In the present embodiment, when the enable line 216 is low, all row drivers 220*a*–220*c* of FED screen 200 are disabled or switched to their off potential and no row is energized. When the enable line 216 is high, the row drivers 220*a*–220*c* are enabled.

In the particular embodiment of FIG. 3, a horizontal clock signal is also supplied to each row driver 220*a*–220*c* in parallel over clock line 214. The horizontal clock signal or synchronization signal pulses upon each time a new row is to be energized. The n rows of a frame are energized, one at a time, to form a frame of data. Assuming an exemplary frame update rate of 60 Hz, all rows are updated once every 16.67 milliseconds. Assuming n rows per frame update, the horizontal clock signal pulses once every 16.67/n milliseconds. In other words a new row is energized every 16.67/n milliseconds. If n is 400, the horizontal clock signal pulses once every 41.67 microseconds.

All row drivers of FED 200 are configured to implement one large serial shift register having n bits of storage, one bit per row. Row data is shifted through these row drivers using a row data line 212 that is coupled to the row drivers 220*a*–220*c* in serial fashion. During sequential frame update mode, all but one of the bits of the n bits within the row drivers contain a "0" and the other one contains a "1". Therefore, the "1" is shifted serially through all n rows, one at a time, from the upper most row to the bottom most row. Upon a given horizontal clock signal pulse, the row corresponding to the "1" is then driven for the on-time window. The bits of the shift registers are shifted through the row drivers 220*a*–220*c* once every pulse of the horizontal clock as provided by line 214. In interlace mode, the odd rows are updated in series followed by the even rows. A different bit pattern and clocking scheme is therefore used.

The row corresponding to the shifted "1" becomes driven responsive to the horizontal clock pulse over line 214. The row remains on during a particular "on-time" window. During this on-time window, the corresponding row is driven with a row-on voltage. In one embodiment, the row-on voltage is the same as the voltage over voltage supply line 212 if the row drivers are enabled. The rows corresponding to the "0" remain "off," and these rows are driven with a row-off voltage. Significantly, according to one embodiment of the present invention, the row-off voltage is pre-set at a particular level such that electron-emissive elements coupled to the "off" rows are reverse-biased. The row-off voltage and the reverse-biasing mechanisms will be discussed more fully below.

As shown by FIG. 3, there are three columns per pixel within the FED flat panel display 200 of the present invention. Column lines 250*a* control one column of pixels, column lines 250*b* control another column line of pixels, etc. FIG. 3 also illustrates the column drivers 240 that control the gray-scale information for each pixel. The column drivers 240 drive amplitude modulated voltage signals over the column lines. In an analogous fashion to the row driver circuits, the column drivers 240 can be broken into separate circuits that each drive groups of column lines. The amplitude modulated voltage signals driven over the column lines 250*a*–250*e* represent gray-scale data for a respective row of pixels. Once every pulse of the horizontal clock signal at line 214, the column drivers 240 receive gray-scale data to independently control all of the column lines 250*a*–250*e* of a pixel row of the FED flat panel display screen 200. Therefore, while only one row is energized per horizontal clock, all columns 250*a*–250*e* are energized during the on-time window. The horizontal clock signal over line 214 synchronizes the loading of a pixel row of gray-scale data into the column drivers 240. Column drivers 240 receive column data over column data line 205 and column drivers 240 are also coupled in common to a column voltage supply line 207.

Different voltages are applied to the column lines by the column drivers 240 to realize different gray-scale colors. In operation, all column lines are driven with gray-scale data (over column data line 205) and simultaneously one row is activated. This causes a row of pixels of illuminate with the proper gray-scale data. This is then repeated for another row, etc., once per pulse of the horizontal clock signal of line 214, until the entire frame is filled. To increase speed, while one row is being energized, the gray-scale data for the next pixel row is simultaneously loaded into the column drivers 240. Like the row drivers, 220*a*–220*c* the column drivers assert their voltages within the on-time window. Further, like the row drivers 220*a*–220*c,* the column drivers 240 have an enable line. In one embodiment, the columns are energized with a positive voltage. In the present embodiment, the column voltages are modulated between a column full-on voltage and a column-off voltage.

Figure 4A:
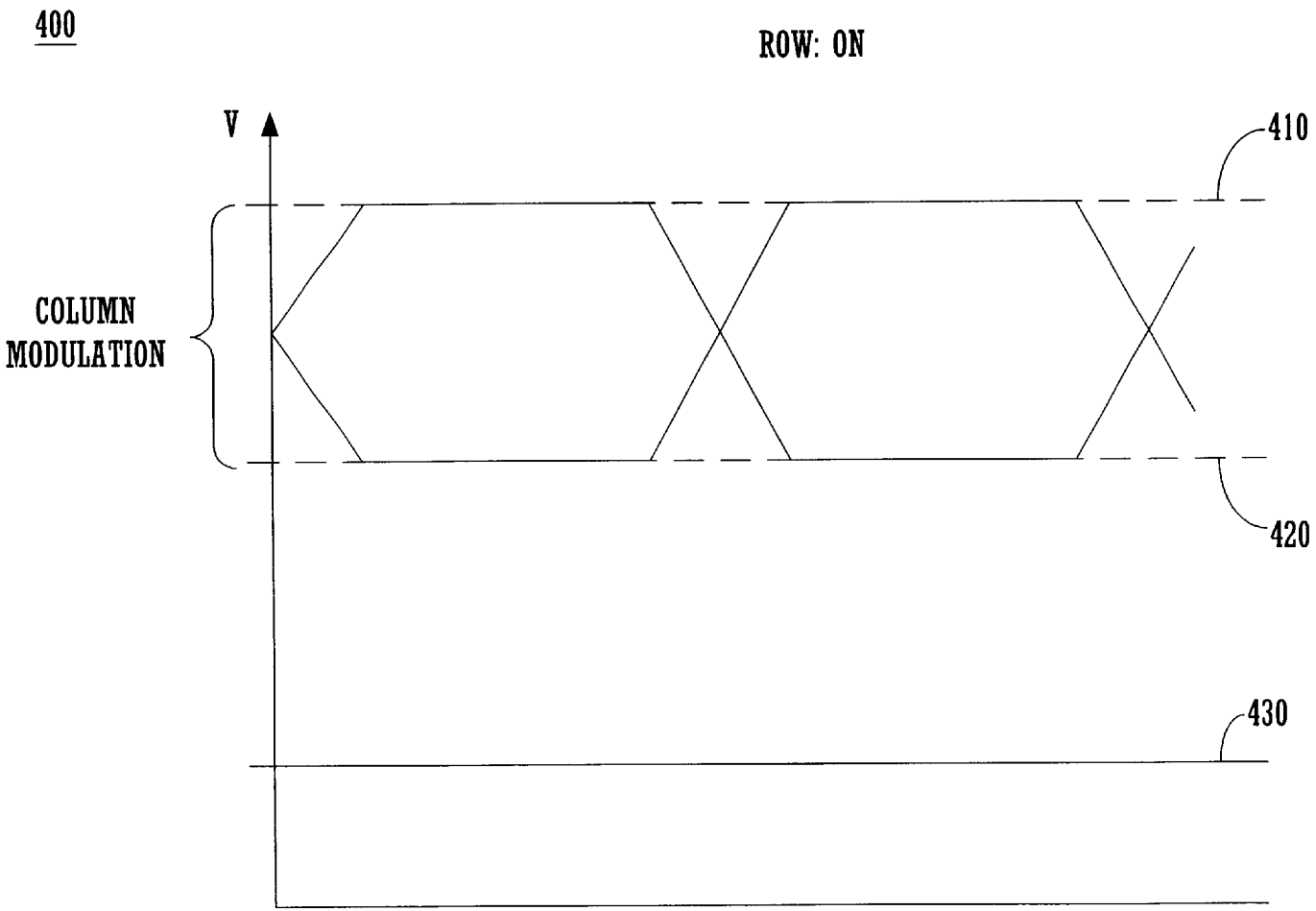
FIG. 4A illustrates a voltage application technique for turning on a row according to one embodiment of the present invention.
Figure 4B:
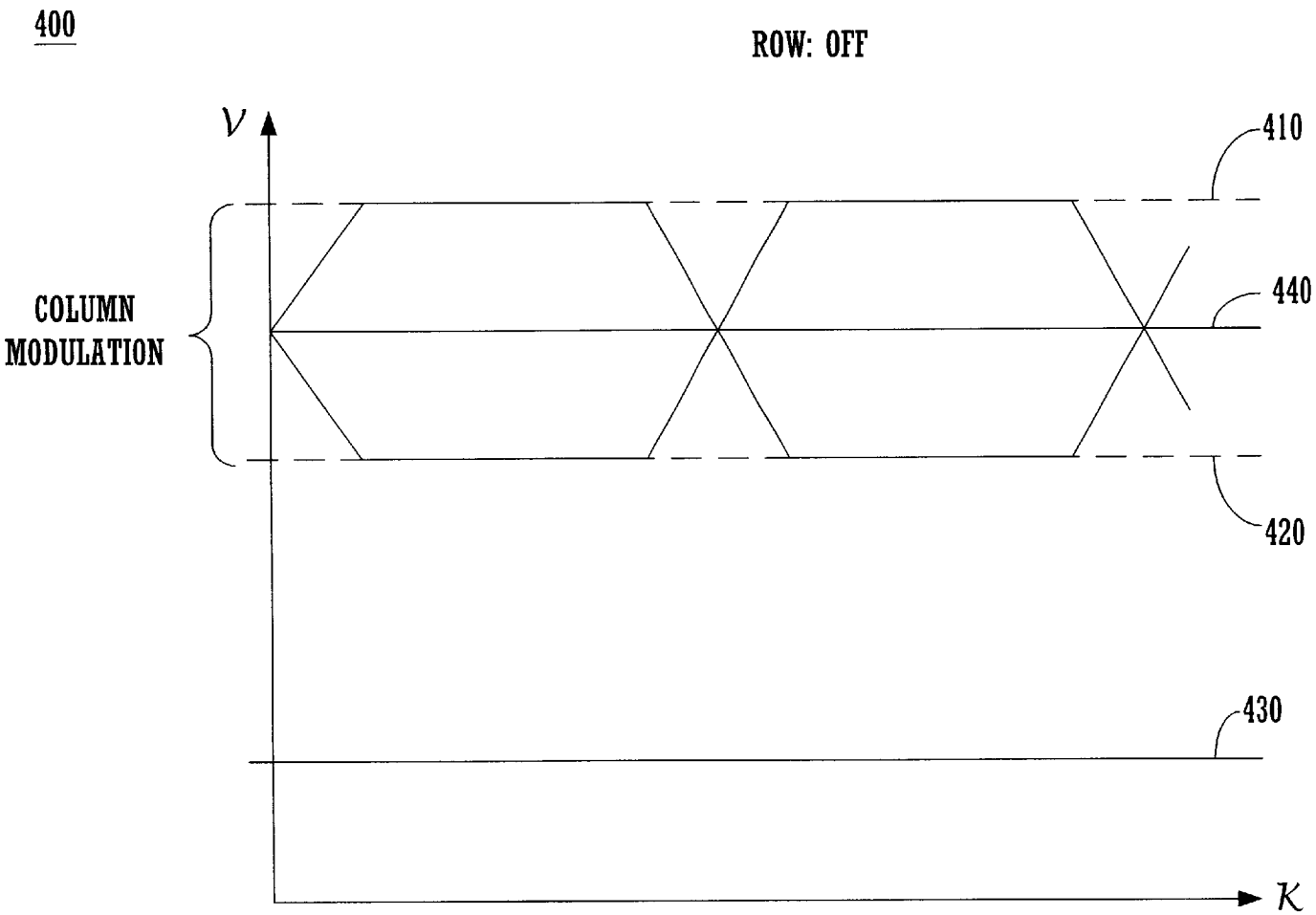
FIG. 4B illustrates a voltage application technique for turning off a row according to one embodiment of the present invention.

Electronic Driving Scheme of the Field Emission Display According to the Present Invention FIGS. 4A and 4B illustrate an electronic driving methodology 400 for row drivers 220*a–c* and column drivers 240 of FIG. 3 according to one embodiment of the present invention. In the present embodiment, column voltages are modulated between a column full-on voltage 410 and a column off voltage 420 to display color data. Color intensity varies depending on the relative column voltage driven. In the particular embodiment as shown, column full-on voltage 410 is positive (e.g. +15V) relative to system ground GND, while column off voltage 420 is at GND. Column voltages are modulated within the above specified range according to column data provided to column drivers 240 over signal line 205.

Significantly, in the present embodiment, row voltages are driven over row lines 230*a–c*. Referring to FIG. 4A, a row line ($Row_i$) is activated when row drivers 220*a–c* drive a row-on voltage 430 over the row line. Referring to FIG. 4B, the row line ($Row_i$) is deactivated when the row drivers 220*a–c* drive a row-off voltage 440 over the row line. In the present embodiment, Only one row is driven at any time. Further, in one embodiment, row-on voltage 430 is negative at −25V, and row-off voltage 440 is halfway between column full-on voltage 410 and column-off voltage 420. In this way, when a row line is deactivated and when the column voltage is driven below the row-off voltage 440, electron emissive elements 40 disposed between the row line and the column lines are reverse-biased. This is true for all deactivated rows. In accordance with the present invention, by intermittently reverse-biasing the electron emissive elements 40, significant extension of operational life of the FED is achieved because contaminant molecules with low binding energies are desorbed during reverse-biasing of the emitters.

Figure 5:
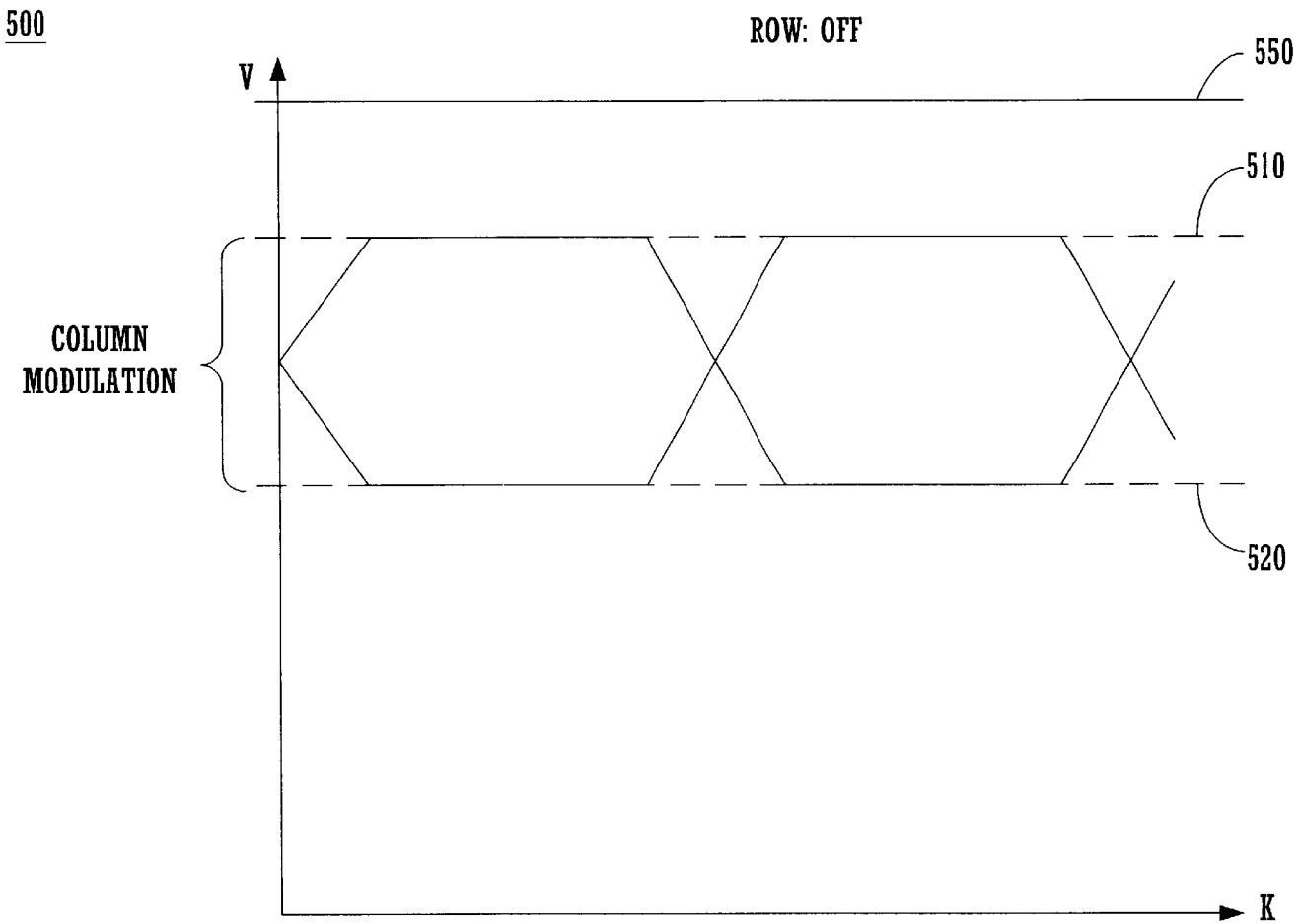
FIG. 5 illustrates a voltage application technique for turning off a row according to another embodiment of the present invention.

FIG. 5 illustrates an electronic driving methodology 500 for row drivers 220*a–c* and column drivers 240 of FIG. 3 according to another embodiment of the present invention. In the present embodiment illustrated in FIG. 5, column voltages are modulated between column full-on voltage 510 and column-off voltage 520. As shown, column full-on voltage 510 is positive (e.g. +15V) relative to GND, while a column-off voltage 520 is at GND. Row lines are also activated when a row-on voltage (e.g. −25V) is driven over the row lines.

According to the present embodiment as shown in FIG. 5, row-off voltage 550 is more positive voltage than column full-on 510 voltage. In the present embodiment as illustrated, row-off voltage 550 is set at approximately +20V while column-off voltage is at +15V. Consequently, whenever a row line is deactivated, electron emissive elements 40 coupled to the row line are reverse-biased. In accordance with the present invention, by using the electronic scheme 500 of the present embodiment, emission current may increase over time. Thus, the present embodiment not only prevents emitter degradation, but may also be used to improve the luminosity of the FED screens.

It is important to note that the electronic driving methodologies 400 and 500 are applicable to FEDs having row lines 230*a–c* coupled to emitter cathodes 60/40, and having column lines 250 coupled to gate electrodes 50. Thus, as illustrated, the row driving voltage is negative in polarity and the column driving voltage is positive in polarity. In some other FED designs also of the present invention, however, row lines may be coupled to gate electrodes, and column lines are coupled to emitter cathodes. In those FED designs, the row driving voltage is positive in polarity, and the column driving voltage is negative in polarity. It should be appreciated that the present invention may also be applied to those FED designs. For instance, it should be apparent to those of ordinary skill in the art, upon reading the present disclosure, that in FEDs having a positive row driving voltage, the row-off voltage may be set to be more negative than the column-off voltage for causing the electron-emissive elements to be reverse-biased.

Figure 6:
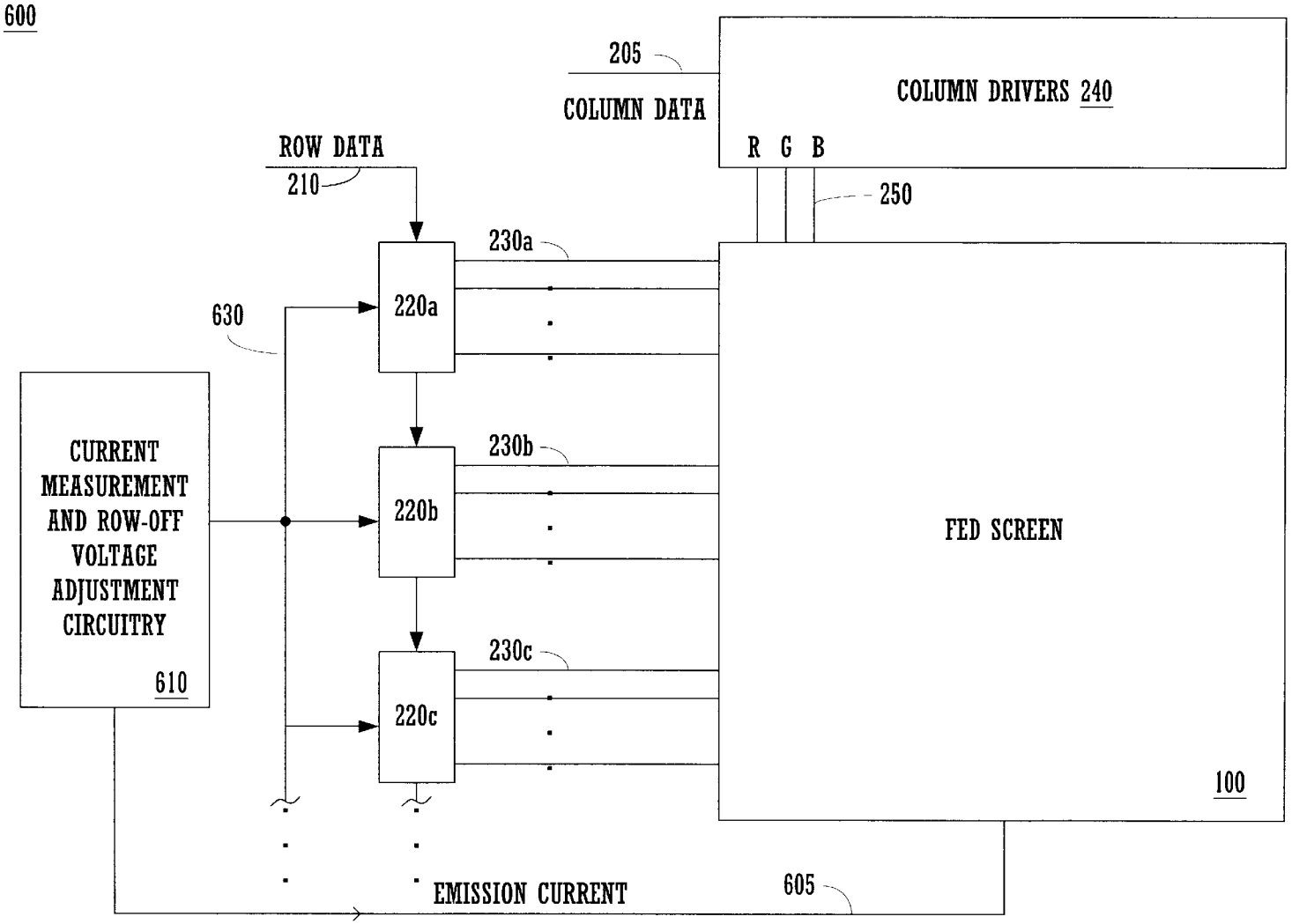
FIG. 6 illustrates a logical block diagram of one embodiment of the present invention using a current sensor and a feed-back circuit for automatically normalizing the luminosity of the flat panel FED screen.

In one embodiment of the present invention, it is desirable to provide a mechanism for fine tuning the row-off voltage of the row drivers 220*a–c* such that the luminosity of the FED screen 100 is maintained at a constant level. This is done, in some cases to prevent degradation of the contrast ratio of the FED screen 100. Thus, according to the present invention, a circuit is provided for normalizing the luminosity of the FED screen 100. FIG. 6 illustrates a logical block diagram 600 of the present invention with feed-back mechanisms for automatically normalizing the luminosity of the flat panel FED screen. As shown in FIG. 6, FED screen 100 is coupled to column drivers 240 and row drivers 220*a–c* to receive column voltage signals and row voltage signals via column lines 250 and row lines 230*a–c,* respectively.

Significantly, anode 70 (FIG. 1) of the FED screen 100 is electrically coupled to a current sensor and row-off voltage adjustment circuitry 610 via line 605. Circuitry 610 is configured for monitoring the emission current of the FED screen 100, and for comparing the emission current with a reference value. The difference between the emission current and the reference value may then be used as an "attenuation" factor for normalizing the luminosity of the FED screen 100. In the particular embodiment as shown, the attenuation factor is transmitted to the row drivers 220*a–c* via signal line 630.

In this way, if the reverse-bias of the electron-emissive elements over-compensates for the effects of emitter degradation, the potential difference between the row-off voltage and the column-off voltage may be decreased. For instance, if the row-off voltage is pre-set at +8.5V, and if the emission current is higher than the reference value, circuitry 610 may then adjust the row drivers 220*a–c* to decrease the row-off voltage to a lower value, e.g. +8V. Similarly, if the reverse-bias does not sufficiently reduce emitter-degradation, the potential difference between the row-off voltage and the column off voltage may then be increased. For example, if the row-off voltage is pre-set at +7.5 V, and if the emission current is lower than the reference value, then circuitry 610 may adjust row drivers 220*a–c* to increase the row-off voltage to +8 V.

Circuits for measuring and comparing currents are well known in the art. In addition, it should also be apparent to those of ordinary skill in the art, upon reading the present disclosure, that modifications to standard row drivers may be made to allow the row-off voltage to be adjusted according to the attenuation factor. Therefore, detailed descriptions of those circuits are not discussed herein to avoid obscuring aspects of the present invention.

Figure 7:
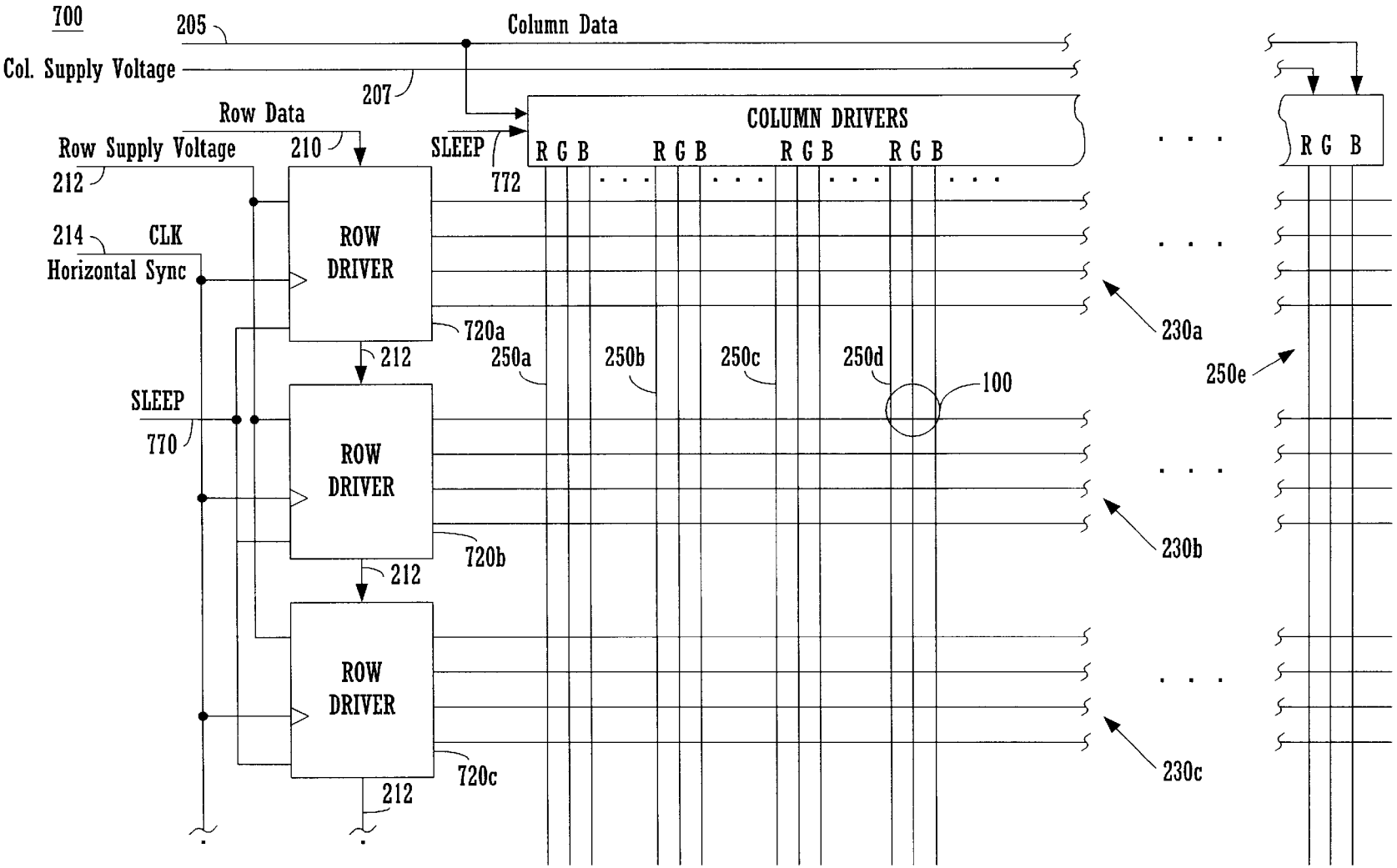
FIG. 7 illustrates a logical block diagram of another embodiment of the present invention in which row drivers and column drivers are configured for receiving a SLEEP signal.

Extending Operational Life of Fed by Reverse-Biasing Electron-Emissive Elements During Sleep Mode FIG. 7 illustrates a logical block diagram of an FED 700 according to another embodiment of the present invention. In this embodiment, row drivers 720*a–c* are configured for receiving a SLEEP signal via control line 770, and column drivers 740 are configured for receiving the SLEEP signal via control line 772. Further, row drivers 720*a–c* and column drivers 740 are configured to drive a row sleep-mode voltage over row lines 230*a–c,* and to drive a column sleep-mode voltage over column lines 250 in response to the SLEEP signal. Particularly, when the row sleep-mode voltage and the column sleep-mode voltage are driven over row lines 230*a–c* and column lines 250, the electron-emissive elements 40 disposed between the row lines 230*a–c* and the column lines 250 are reverse-biased. In this way, the operational life of the FED screen 100 is substantially extended.

According to one embodiment of the invention, in FEDs where the row driving voltage is negative in polarity, the row sleep-mode voltage is more positive than the column sleep-mode voltage. In another embodiment, in FEDs where the row driving voltage is positive in polarity, the row sleep-mode voltage is less positive than the column sleep-mode voltage. For instance, in FEDs where the row lines 230 are coupled to electron emissive elements 40, the column sleep-mode voltage may be at GND while the row sleep-mode voltage is at +20V. It should be appreciated that many other voltage schemes may be applied as long as the electron-emissive elements 40 are reverse-biased during the sleep-mode.

Figure 8:
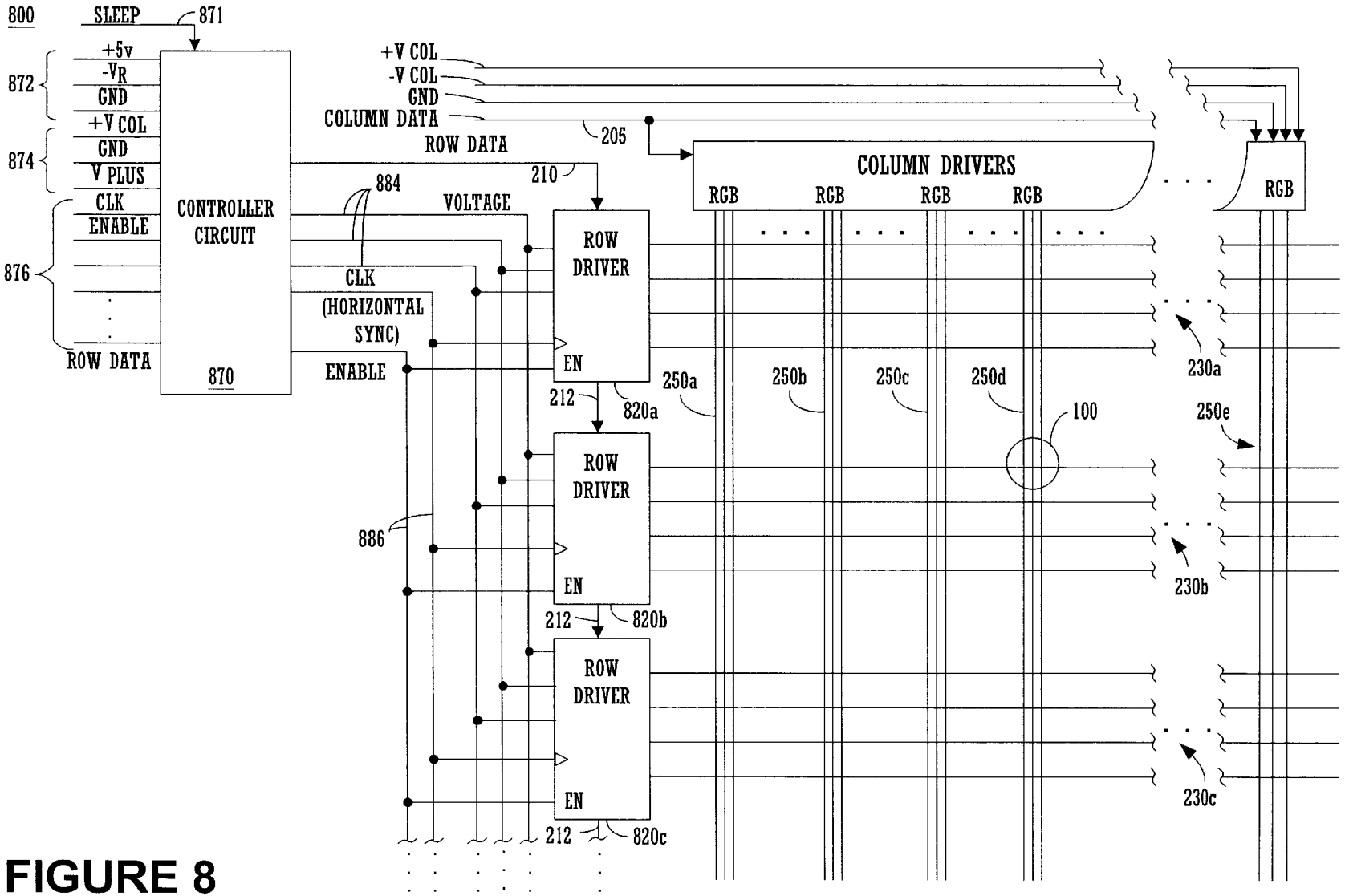
FIG. 8 illustrates a logical block diagram of another embodiment of the present invention having a controller circuit for selectively providing a first set of reference voltages and a second set of reference voltages to the row driver circuit.

FIG. 8 illustrates another embodiment of the present invention. As shown, FED 800 comprises a controller circuit 870 for receiving the SLEEP signal via SLEEP signal line 871. Further, controller circuit 870 is configured for receiving a first set of reference voltages via signal lines 872, a second of reference voltages via signal lines 874, and FED data and control signals (e.g. row data, CLK, FLM, ENABLE, etc.) via signal lines 876. Significantly, controller circuit 870 provides (via signal lines 884) a first set of reference voltages to the row drivers 820*a–c* when the SLEEP signal is not asserted, and provides a second set of reference voltages to the row drivers 820*a–c* when the FED 800 is in the sleep mode. An advantage of the present embodiment is that, by using the controller circuit 870 to modify the reference voltages to the row drivers 820*a–c,* conventional row drivers may be used without substantial modification.

In operation, when the SLEEP signal is not asserted, controller circuit 870 provides a positive reference voltage, a negative reference voltage, and a ground reference voltage to row drivers 820*a–c*. For instance, a positive reference voltage of +12V, a negative reference voltage may be −12V, and a ground reference voltage of 0V may be provided to the row drivers 820*a–c*. The row drivers 820*a–c,* in response to these voltages, generate normal operating row voltages for driving the row lines 230*a–c*. However, when the SLEEP signal is asserted, controller circuit 870 provides a second set of reference voltages to the row drivers 820*a–c*. For instance, a positive reference voltage of +24V, a negative reference voltage of 0V, and a ground reference voltage of +12V may be provided to row drivers 820*a–c*. The row drivers 820*a–c,* in response to the second set of reference voltages, generate the row sleep-mode voltage for reverse-biasing the electron emitters. In this way, row drivers 820*a–c* may be implemented with conventional FED row drivers. Table 1 below summarizes the two exemplary sets of reference voltages for row drivers 820*a–c* according to one embodiment of the present invention.

TABLE 1

| Reference Voltages | Normal Operation | Sleep Mode |
|---|---|---|
| Positive Reference Voltage | +5V | $+V_{COL}$ |
| Negative Reference Voltage | $-V_R$ | GND |
| Ground Reference | GND | $V_{PLUS}$ |

In Table 1, $-V_R$ corresponds to a negative reference voltage that is conventionally provided by circuit components of conventional as a negative reference voltage for FED row drivers. On the other hand, $+V_{COL}$ corresponds to a positive reference voltage that is conventionally provided by circuit components of conventional FEDs as a positive reference voltage for FED column drivers. GND represents a system ground reference for the FED, and $V_{PLUS}$ is an arbitrary positive voltage between GND and $+V_{COL}$. It should be appreciated that the reference voltages summarized in Table 1 are exemplary and that other reference voltages may be used to perform substantially equivalent functions.

In accordance with the present embodiment, controller circuit 870 may include opto-isolation circuitry for converting FED data and control signals, such as row data, FLM (first line marker), CLK (reference clock), etc., to signals readable by row drivers 820*a–c* in both normal operation and sleep mode. In the particular embodiment as shown, controller circuit 870 receives FED data control signals via signal lines 876, and transmits the converted FED data and control signals to row driver 820*a–c* via signal lines 886. In this way, signals generated by other system components may be transmitted to row drivers 820*a–c* even when the reference voltages of row drivers 820*a–c* are shifted. Opto-isolation circuits are well known in the art. Therefore, particular details of the opto-isolation circuitry 880 are not described herein in order to avoid obscuring aspects of the invention.

Figure 9A:
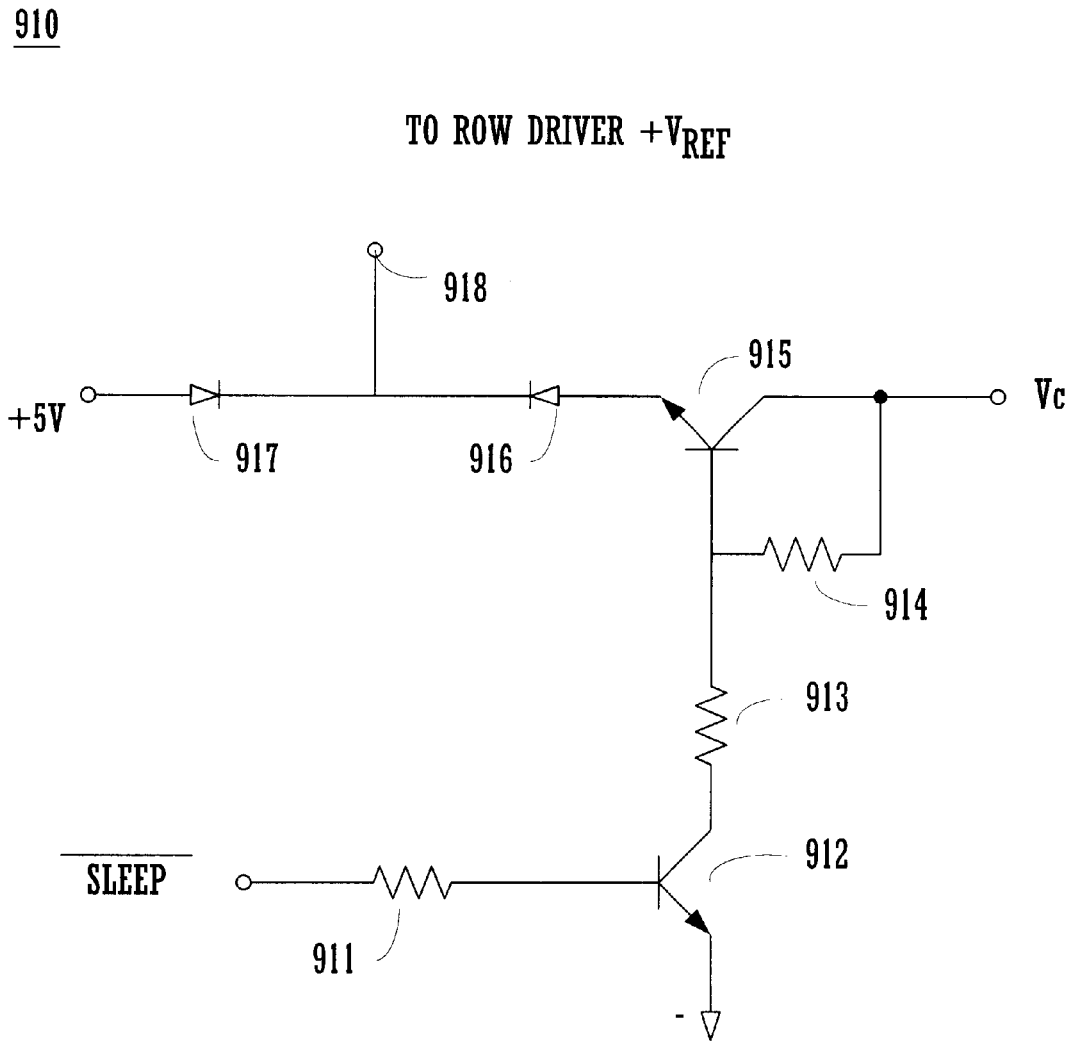
FIG. 9A illustrates a portion of the controller circuit of FIG. 8 according to one embodiment of the present invention.

FIG. 9A illustrates a circuitry 910 of the controller circuit 870 of FIG. 8. As shown, circuitry 910 includes a resistor 911 having a first end coupled to receive a _SLEEP signal and a second end coupled to a base of PNP transistor 912. An emitter of transistor 912 is coupled to system ground GND, and a collector of transistor 912 is coupled to a first end of resistor 913. A second end of resistor 913 is coupled to a base of PNP transistor 915 and to a first end of resistor 914. A second end of resistor 914 is coupled to a collector of transistor 915, and is also coupled to a positive voltage $+V_{COL}$ of column drivers 240. An emitter of transistor 915 is coupled to an anode of diode 916. A cathode of diode 916 is coupled to a cathode of diode 917, and to an output 918 for coupling to a positive reference voltage input of row drivers 820*a–c*. An anode of diode 917 is coupled to a positive voltage +5V.

In operation, circuitry 910 switches the output 918 from +5V to $+V_{COL}$ depending on the status of the SLEEP signal. In particular, when the SLEEP signal is not asserted (or_SLEEP is asserted), output 918 provides a voltage of +5V to the positive reference voltage input of row driver 820*a–c* . However, when the SLEEP signal is asserted (or_SLEEP is not asserted), then output 918 provides a voltage of $+V_{COL}$ (e.g. +20V) to the positive reference voltage input of row driver 820*a–c*. It should be appreciated that circuitry 910 is described for illustration purposes only, and that a person of ordinary skill in the art, upon reading the present disclosure, would be able to practice the present invention with other circuits that can perform substantially equivalent functions.

Figure 9B:
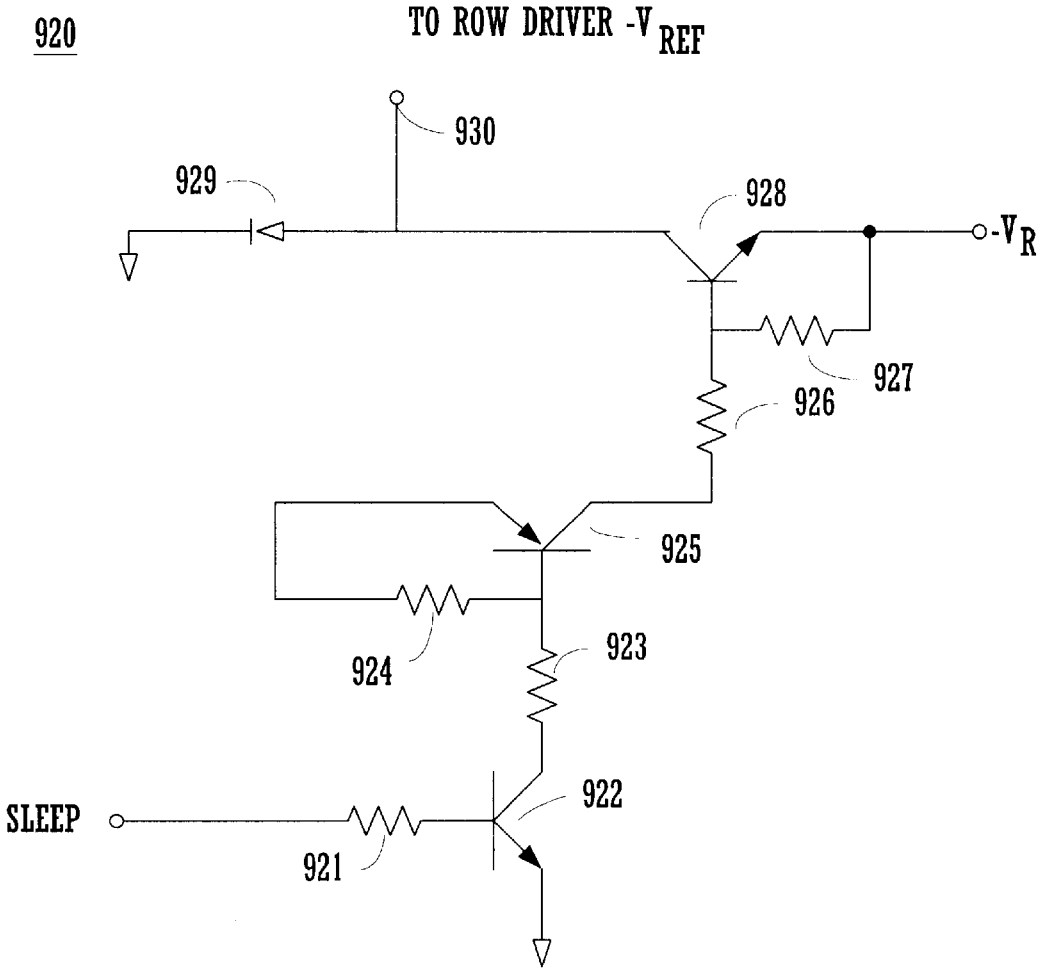
FIG. 9B illustrates another portion of the controller circuit of FIG. 8 according to one embodiment of the present invention.

FIG. 9B illustrates circuitry 920 of the controller circuit 870 of FIG. 8. As shown, circuitry 920 includes a resistor 921 having a first end coupled to receive the SLEEP signal, and a second end coupled to a base of PNP transistor 922. PNP transistor 922 includes an emitter that is coupled to system ground GND, and a collector coupled to a first end of resistor 923. A second end of resistor 923 is coupled to a first end of resistor 924 and to a base of NPN transistor 925. An emitter of transistor 925 is coupled to a second end of resistor 924, and to a negative reference voltage $-V_R$, which is provided by the system components of the FED. A collector of transistor 924 is coupled to a first end of resistor 926. A second end of resistor 926 is coupled to a first end of resistor 927 and a base of PNP transistor 928. An emitter of transistor 928 is coupled to a second end of resistor 927, and a collector of transistor 928 is coupled to an anode of diode 929, and to an output 930 for coupling to a negative reference voltage input of row drivers 820*a–c*. A cathode of diode 929 is coupled to system ground GND.

In operation, circuitry 920 switches the output 930 from system ground GND to $-V_R$ depending on the status of the SLEEP signal. In particular, when the SLEEP signal is not asserted (or_SLEEP is asserted), output 930 provides a voltage of $-V_R$ to the negative reference voltage input of row driver 820*a–c*. However, when the SLEEP signal is asserted (or_SLEEP is not asserted), then output 930 provides a voltage of 0V (e.g. GND) to the negative reference voltage input of row driver 820*a–c*. It should be appreciated that circuitry 920 is described for illustration purposes only, and that a person of ordinary skill in the art, upon reading the present disclosure, would be able to practice the present invention with other circuits that can perform substantially equivalent functions.

Figure 9C:
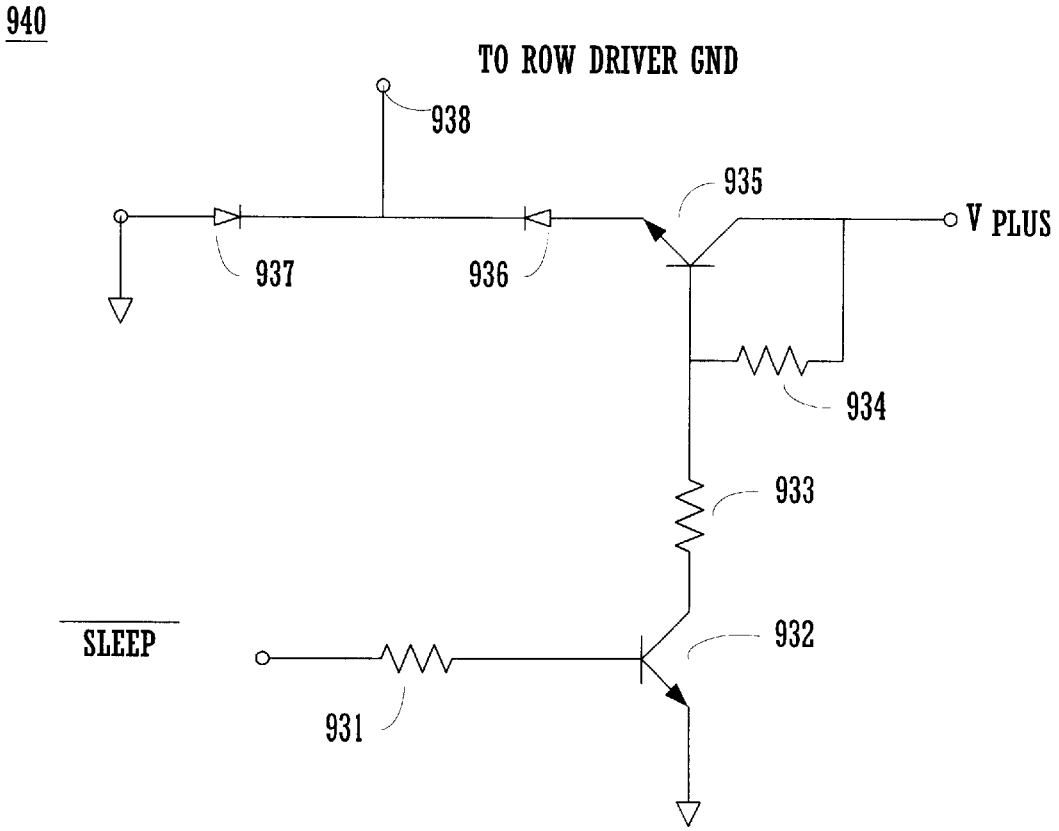
FIG. 9C illustrates yet another portion of the controller circuit of FIG. 8 according to one embodiment of the present invention.

FIG. 9C illustrates a circuitry 940 of the controller circuit 870 of FIG. 8. As shown, circuitry 940 includes a resistor 931 having a first end coupled to receive a_SLEEP signal and a second end coupled to a base of PNP transistor 912. An emitter of transistor 932 is coupled to system ground GND, and a collector of transistor 932 is coupled to a first end of resistor 933. A second end of resistor 933 is coupled to a base of PNP transistor 935 and to a first end of resistor 934. A second end of resistor 934 is coupled to a collector of transistor 935, and is also coupled to a positive voltage $V_{PLUS}$. In one embodiment, the voltage $V_{PLUS}$ is an arbitrary positive voltage between system ground GND and $+V_{COL}$. An emitter of transistor 935 is coupled to an anode of diode 936. A cathode of diode 936 is coupled to a cathode of diode 937, and to an output 938 for coupling to a ground reference input of row drivers 820*a–c*. An anode of diode 937 is coupled to system ground GND.

In operation, circuitry 940 switches the output 938 from system ground GND to $V_{PLUS}$ depending on the status of the SLEEP signal. In particular, when the SLEEP signal is not asserted (or_SLEEP is asserted), output 938 provides a system ground GND reference to the ground reference input of row driver 820*a–c*. However, when the SLEEP signal is asserted (or_SLEEP is not asserted), then output 938 provides a voltage of $V_{PLUS}$ (e.g. +10V) to the ground reference input of row driver 820*a–c*. It should be appreciated that circuitry 940 is described for illustration purposes only, and that a person of ordinary skill in the art, upon reading the present disclosure, would be able to practice the present invention with other circuits that can perform substantially equivalent functions.

It should also be appreciated that circuitries 910, 920 and 940 are designed for FEDs where the row lines are coupled to electron-emitters and where the column lines are coupled to gate electrodes. However, it should be apparent to those of ordinary skill in the art, upon reading the present disclosure, that the principles of the present invention may be applied to other FED designs as well.

Intermittent Reverse-Biasing of Gate-Emitter Structures During Vertical Blanking Interval In yet another embodiment of the present invention, the gate-emitter structures of an FED are reverse-biased during a vertical blanking interval. Specifically, in FEDs, there exists a time period called the vertical blanking interval (or vertical blanking time) after each frame is displayed but before the next frame begins. The duration of the vertical blanking time is typically 1% of the total frame time. According to the present embodiment, during the vertical blanking interval, emitters 40 of the FED are reverse-biased. In this way, intermittent reverse-biasing of the emitters 40 is achieved and emitter-life is effectively improved.

In the present embodiment, reverse-biasing of the emitters 40 is accomplished by forcing all column drivers 240 to drive the column-off voltage (e.g. voltage level 420 of FIGS. 4A and 4B) over the column lines 250 during the vertical blanking interval. Rows drivers 220*a–c* are configured to drive the row-off voltage (e.g. voltage level 440 of FIG. 4B) over the row lines 230 *a–c* during the vertical blanking interval. As most display controllers include an output that specifically defines the vertical blanking time, the present embodiment may be implemented with simple logic incorporated within the column drivers 240. It should also be appreciated that the present embodiment may also be implemented in other equivalent manners without departing from the scope and spirit of the present invention.

The present invention, a system and method for improving emitter life in flat panel FEDs, has thus been disclosed. Using the present invention, emitter life is substantially improved. A significant advantage of the present invention is that minimal modification to existing FED circuitries are necessary to implement the present invention. While the present invention has been described in particular embodiments, it should be appreciated that the present invention should not be construed as limited by such embodiments, but rather construed according to the below claims.

What is claimed is:

1. A field emission display comprising:

a plurality of row lines, a plurality of column lines, and a plurality of electron emissive elements disposed at intersections of said plurality of row lines and column lines;

a column driver coupled to said plurality of column lines, said column driver for driving modulated voltage signals over said plurality of column lines when said field emission display is in an operating mode, and for driving a pre-determined column voltage over said respective column line when said field emission display is in a sleep mode; and a row driver coupled to said plurality of row lines, said row driver for selectively activating and deactivating a respective one of said plurality of row lines when said field emission display is in said operating mode, and for driving a pre-determined row voltage over said plurality of row lines when said field emission display is in said sleep mode, wherein said plurality of electron emitters are reverse-biased by said pre-determined column voltage and said by said pre-determined row voltage when said field emission display is in said sleep mode.

2. The field emission display as recited in claim 1 wherein said pre-determined column voltage is approximately at 0 volt.

3. The field emission display as recited in claim 1 wherein said pre-determined row voltage is approximately at +30 volts.

4. The field emission display as recited in claim 1 wherein said pre-determined row voltage is positive with respect to said pre-determined column voltage.

5. The field emission display as recited in claim 1 further comprising a controller circuit for selectively activating and deactivating said sleep mode in response to a sleep mode control signal.

6. The field emission display as recited in claim 5 wherein said controller circuit is for providing a first set of reference voltages to said column driver and to said row driver when said field emission display is in said operating mode, and for providing a second set of reference voltages to said column driver and to said row driver when said field emission display is in said sleep mode.

7. The field emission display as recited in claim 6 wherein said controller circuit further comprises:

an opto-isolation circuit for converting input signals corresponding to said first set of reference voltages to input signals corresponding to said second set of reference voltages.

8. Electronic circuitry for exciting a field emission display, said field emission display having a plurality of row lines, a plurality of column lines, and a plurality of electron emissive elements disposed at intersections of said plurality of row lines and column lines, said electronic circuitry comprising:

a column driver for coupling to said plurality of column lines, said column driver for driving modulated voltage signals over said plurality of column lines when said field emission display is in an operating mode, and for driving an pre-determined column voltage over said respective column line when said field emission display is in a sleep mode; and an row driver for coupling to said plurality of row lines, said row driver for selectively activating and deactivating a respective one of said plurality of row lines when said field emission display is in said operating mode, and for driving an pre-determined row voltage over said plurality of row lines when said field emission display is in said sleep mode, wherein said plurality of electron emitters are reverse-biased when said field emission display is in said sleep mode.

9. The electronic circuitry as recited in claim 8 wherein said pre-determined column voltage is approximately at 0 volt.

10. The electronic circuitry as recited in claim 8 wherein said pre-determined row voltage is approximately at +30 volts.

11. The electronic circuitry as recited in claim 8 wherein said pre-determined row voltage is positive with respect to said pre-determined column voltage.

12. The electronic circuitry as recited in claim 8 further comprising a controller circuit for selectively activating and deactivating said sleep mode in response to a sleep mode control signal.

13. The electronic circuitry as recited in claim 12 wherein said controller circuit is for providing a first set of reference voltages to said column driver and to said row driver when said field emission display is in said operating mode, and for providing a second set of reference voltages to said column driver and to said row driver when said field emission display is in said sleep mode.

14. The electronic circuitry as recited in claim 13 wherein said controller circuit further comprises:

an opto-isolation circuit for converting input signals corresponding to said first set of reference voltages to input signals corresponding to said second set of reference voltages.

15. A method of operating a field emission display that has a plurality of row lines, a plurality of column lines, and a plurality of electron emissive elements disposed at intersections of said plurality of row lines and column lines, said method comprising the steps of:

driving modulated voltage signals over said plurality of column lines when said field emission display is in an operating mode;

driving a pre-determined column voltage over said respective column line when said field emission display is in a sleep mode;

selectively activating and deactivating a respective one of said plurality of row lines when said field emission display is in said operating mode; and driving a pre-determined row voltage over said plurality of row lines when said field emission display is in said sleep mode, wherein said plurality of electron emitters are reverse-biased by said pre-determined column voltage and said by said pre-determined row voltage when said field emission display is in said sleep mode.

16. A method as recited in claim 15 wherein said pre-determined column voltage is approximately at 0 volt.

17. A method as recited in claim 15 wherein said pre-determined row voltage is approximately at +30 volts.

18. A method as recited in claim 15 wherein said pre-determined row voltage is positive with respect to said pre-determined column voltage.

19. A method as recited in claim 15 further comprising the step of selectively activating and deactivating said sleep mode in response to a sleep mode control signal.

20. A method as recited in claim 19 further comprising the steps of:

providing a first set of reference voltages to said column driver and to said row driver when said field emission display is in said operating mode; and providing a second set of reference voltages to said column driver and to said row driver when said field emission display is in said sleep mode.

21. A method as recited in claim 20 further comprising the step of converting input signals corresponding to said first set of reference voltages to input signals corresponding to said second set of reference voltages.

* * * * *